United States Patent [19]

Sheffer

[11] Patent Number: 4,661,082

[45] Date of Patent: Apr. 28, 1987

[54] PROMOTIONAL TRUCK ASSEMBLY

[75] Inventor: Phil B. Sheffer, New Oxford, Pa.

[73] Assignee: Merchandising Innovations, Inc., Hanover, Pa.

[21] Appl. No.: 832,631

[22] Filed: Feb. 25, 1986

[51] Int. Cl.[4] ..... A63H 33/16

[52] U.S. Cl. ..... 446/488; 446/434

[58] Field of Search ..... 446/488, 88, 76, 79, 446/80, 93, 434; 229/8; 206/457, 44.11

[56] References Cited

U.S. PATENT DOCUMENTS

| | | | |
|---|---|---|---|
| 654,219 | 7/1900 | Bender, Jr. | 446/76 |
| 2,723,488 | 11/1955 | Ringler | 446/79 |
| 3,581,431 | 6/1971 | Trenovan | 446/488 X |

*Primary Examiner*—Mickey Yu

*Attorney, Agent, or Firm*—Daniel J. O'Connor

[57] ABSTRACT

A display article comprising a promotional truck assembly which is made entirely of corrugated fiberboard materials. A uniquely engineered series of cuts and score lines permits the article to be shipped in a completely flat or knockdown position. Upon receipt by the retail merchant, consumer or collector, the device may be readily assembled into a highly durable and attractive unit. No separate fasteners or glue of any kind are required for assembly of the unit which may be easily completed even by persons unfamiliar with display assembly techniques. It is contemplated that the device would be suitable for advertising and hobby/collector uses.

6 Claims, 3 Drawing Figures

PROMOTIONAL TRUCK ASSEMBLY

This application is generally related to applicant's copending U.S. Pat. application Ser. Nos. 06/836,295 and 06/836,296 both filed Mar. 5, 1986.

Papers relating to the present invention were previously filed under the Disclosure Document Program of the U.S. Patent Office.

BACKGROUND AND OBJECTS OF THE INVENTION

The invention relates generally to display or promotional items which are manufactured of corrugated fiberboard or other easily workable materials.

It would be highly desirable in the advertising and merchandising arts to mass produce attractive advertising articles which may be shipped in a flat or knockdown position and yet easily assembled by the retail merchant.

In particular, the invention relates to a miniature truck assembly having the trademarks of a particular beverage manufacturer printed thereon.

Accordingly, it is an object of the present invention to mass produce a promotional or collector's article of inexpensive and easily manufactured materials.

It is a further objective to produce an advertising device which may be shipped in large quantities in a knockdown position and be readily assembled by the users thereof into a highly durable and attractive miniature promotional unit.

It is also an object of the present invention to provide a promotional device which has factory formed sections therein such that the device may be easily assembled without the use of separate fastener elements.

It is a further object to provide a collector's item having factory formed sections therein such that the device will be securely retained in its fully assembled position.

It is a still further object to demonstrate a promotional article which may be fabricated of lightweight materials to reduce shipping and warehousing costs in the distribution of such articles.

Further objects and advantages of the present invention will become apparent as the following description proceeds, and the features of novelty characterizing the invention will be pointed out with particularity in the claims annexed to and forming a part of this specification.

In production of the promotional device, a flat sheet of corrugated fiberboard material is die cut into a uniquely engineered design which allows the flat sheet to be readily assembled by the user into a durable and highly attractive display item designed to enhance retail sales of a particular product.

PRIOR ART PATENTS

The most relevant prior art patents presently known to the inventor herein are listed as follows: U.S. Pat. No. 2,823,844 issued to Frankenstein on Feb. 18, 1958; U.S. Pat. No. 953,593 issued to Brown on Mar. 29, 1910; U.S. Pat. No. 4,407,494 issued to Hummel on Oct. 4, 1983; and U.S. Pat. No. 4,055,250 issued to Mayhew on Oct. 25, 1977.

The '844 Frankenstein patent illustrates a particular vehicle folding pattern including wheel cut-out components 71 and 72. The Brown '593 patent also illustrates a foldable miniature vehicle design. The Hummel '494 patent illustrates a corrugated paperboard foldable toy apparatus having plural outer sections 22, 23, 24 attached to a central fuselage element 21. The Mayhew '250 patent illustrates a foldable miniature truck design for use specifically to hold items 16 to be sold.

As will be appreciated from the above patents, the prior art consists of designs which are unnecessarily complex to manufacture and to assemble by the consumer. The prior art designs are further characterized in an end product which is not as sturdy and durable in its intended use as the present invention.

As will be appreciated herein, the present invention combines the desirable features of ease of manufacture, reduced shipping costs, ease of assembly by the consumer, and durability in its intended display usage.

DESCRIPTION OF THE PREFERRED EMBODIMENT

Figure 1:
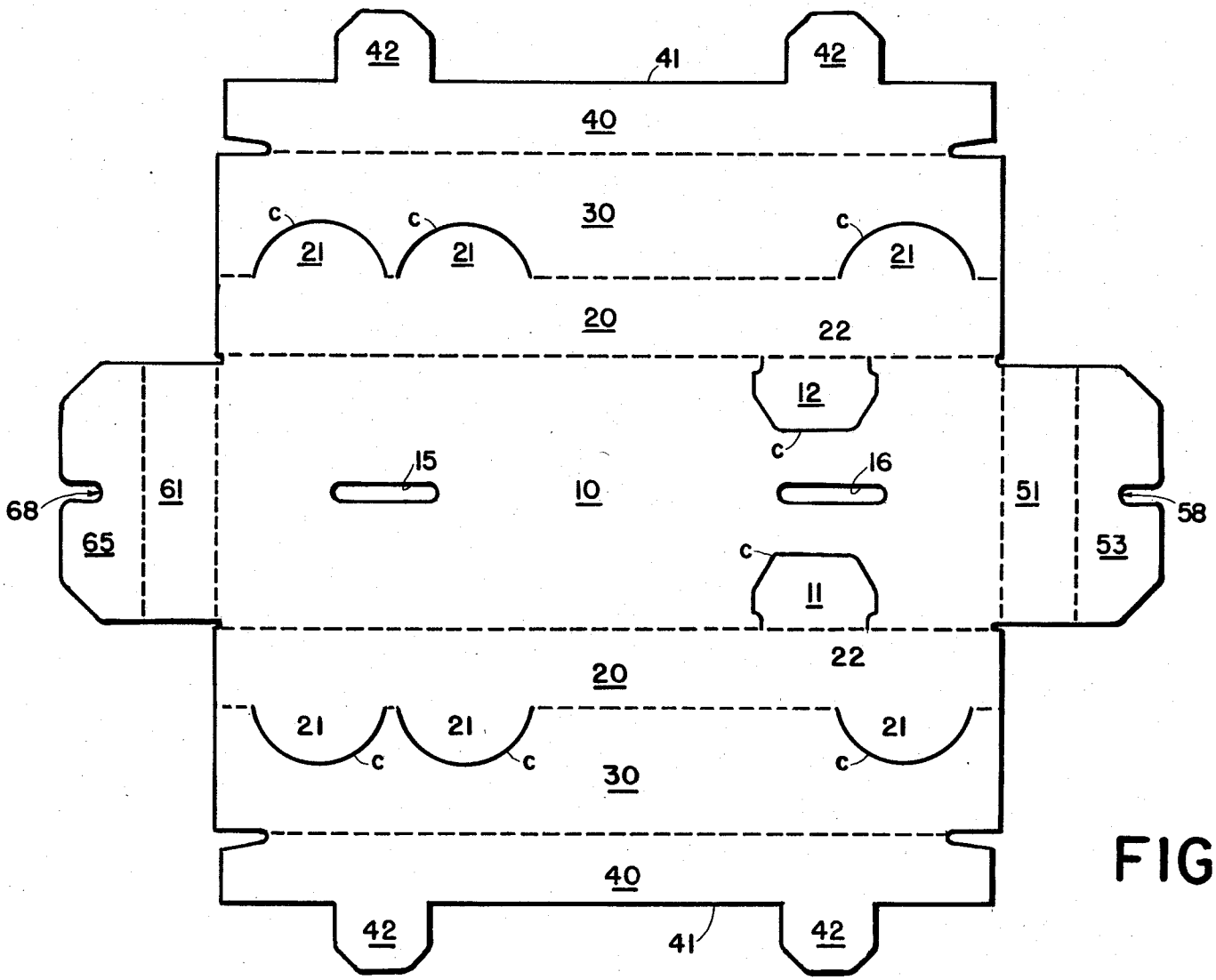
FIG. 1 is a plan view of a flat sheet of corrugated fiberboard having cuts and score lines formed therein in a design which may be folded easily into the shape of a truck base.

Referring now to FIG. 1, the truck base is shown in its flat or knockdown position for shipping purposes.

As shown in its flat position, the corrugated fiberboard has factory applied fold lines shown as dashed lines and factory applied cut through portions shown as solid lines and normally designated by the letter C.

The main sections 10, 20, 30 and 40 are shown as defined by dashed score lines therebetween. The score lines are factory pre-formed utilizing known steel rule die technology. It should also be noted that the solid line sections designated by the letter C represent factory cut through portions to facilitate, for example, the formation of wheel sections 21 and upstanding tab elements 11 and 12 upon assembly of the device.

The significance of the inventive engineering design may be best appreciated by describing the method of assembly of the truck base shown in FIG. 1.

End sections 40 are manually grasped and folded inwardly such that the score line portions between sections 10, 20, 30 and 40 yield.

Tabs 42 of the end sections 40 are then tucked into the slots 15 and 16 formed in the central section 10. In this position, the edges 41 of the end sections 40 lie against the central main section 10 such that the two end sections 40 are in side-by-side, parallel, edge-aligned relationship.

It will thus be appreciated that sections 20 form truck base side wall portions, sections 30 form truck base lower wall portions, and that end sections 40 form a central vertical strengthening strut element upon assembly of the truck base of FIG. 1.

The above steps produce an elongated rectangular cross-sectioned tube having wheel elements 21 extending from a lower side and tab elements 11 and 12, in addition to tabs 42, extending from an upper side thereof.

Completion of the truck base is achieved by folding in end flaps 53 and 65 so that their respective slotted elements, 58 and 68, engage the double wall formed by the previously positioned end sections 40. End flaps 53 and 65 are formed on truck base front and rear vertical walls 51 and 61 respectively.

Figure 2:
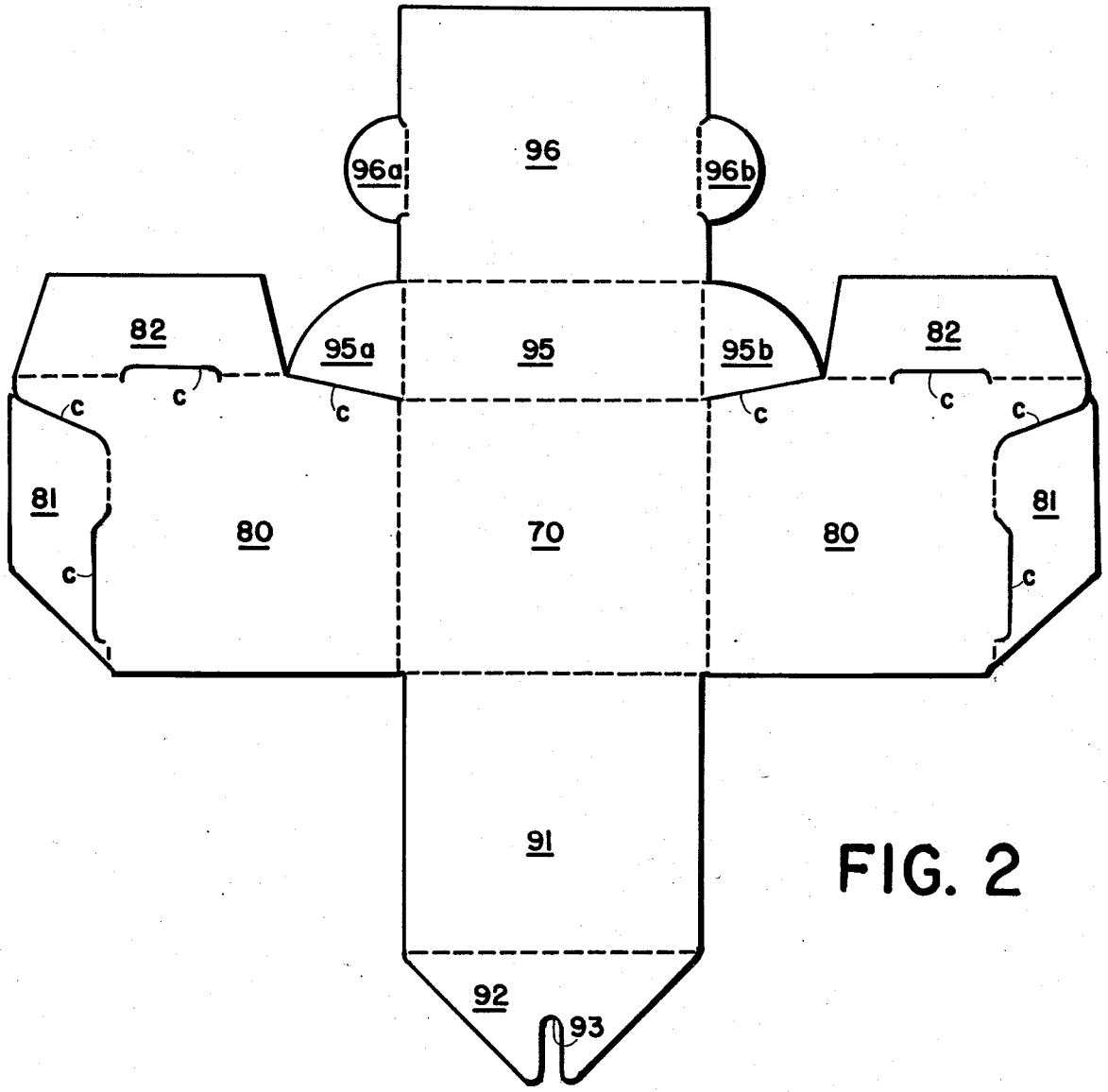
FIG. 2 is a plan view of a sheet which may be folded into the shape of a truck cab to be interlocked with the truck base of FIG. 1.
Figure 3:
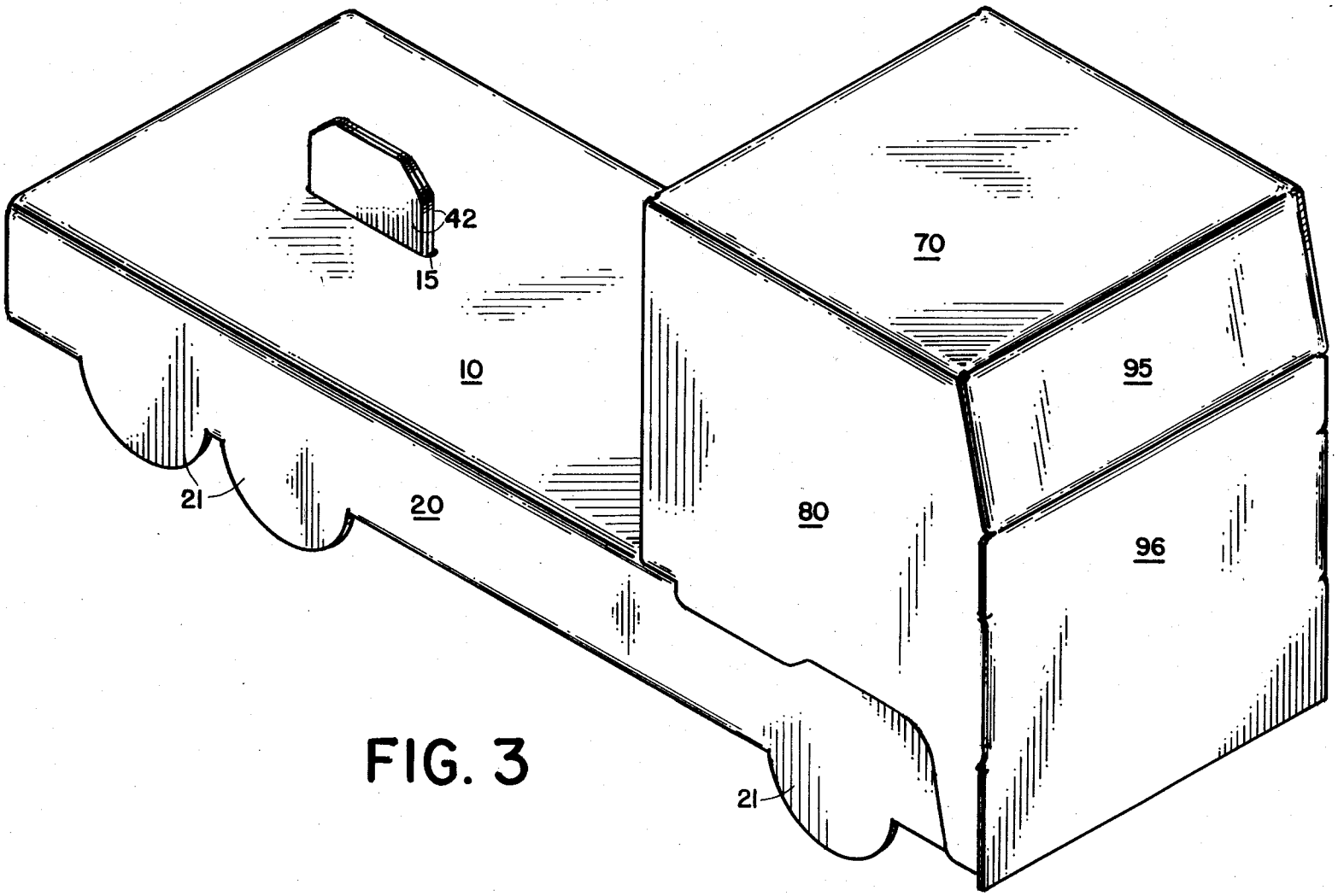
FIG. 3 is a view of the truck in its assembled condition for display use.

Upon completion of the truck base assembly, the cab assembly shown in FIG. 2 may be added thereto. The cab comprises a central cab top 70 and surrounding component parts. Cab side door panels 80 are folded inwardly ninety degrees as are the attached flaps 81. The lower cut portions C of flaps 81 are then slid over upstanding tabs 11 and 12 of the truck base. Simultaneously, the cab rear panel 91 is folded in ninety degrees and flap 92 is attached to the forward upstanding truck base tabs 42 by means of slot 93.

In the next assembly step, flaps 82 are folded inwardly ninety degrees and front cab panels 95 and 96 are folded inwardly such that flaps 95*a* and 95*b* lie within the cab side panels 80. Tabs 96*a* and 96*b* are then slid into the cut lines C of flaps 82 and the assembly is completed.

It will thus be appreciated by those of skill in the art that an easy to assemble yet durable and attractive miniature truck promotional aid is achieved by means of the factory cut corrugated fiberboard design.

The engineered shapes disclosed are of course critical to both the ease of assembly of the device and the durability and attractiveness of the assembled product.

While there has been illustrated and described what is at present considered to be a preferred embodiment of the present invention, it will be appreciated that numerous changes and modifications are likely to occur to those skilled in the art, and it is intended in the appended claims to cover all those changes and modifications which fall within the true spirit and scope of the present invention.

I claim:

1. A miniature display truck made of corrugated fiberboard materials including a truck base assembly and a truck cab assembly, said truck base assembly including a central main section means (10) having a slot means (15, 16) formed along a mid-line thereof, said central main section means (10) further having tab element means (11, 12) formed in lateral portions thereof, wherein said truck base central main section means (10) has base side wall sections (20) formed on both sides thereof, said side wall section (20) having wheel cut-out portions (21) formed thereon, said truck base assembly further including lower wall section means (30) formed exteriorly of said side wall sections (20) by means of score lines therebetween, said truck base assembly further including end section means (40) formed exteriorly of said lower wall section means (30) by means of score lines therebetween, said end section means (40) having tab means (42) formed on the edges (41) thereof; wherein, upon assembly, said end section tab means (42) are tucked into said slot means (15, 16) formed in said central main section (10), wherein said truck base main section means (10) has front and rear vertical wall means (51, 61) formed at the ends thereof and end flap means (53, 65) formed thereon, said end flap means (53, 65) having slot means (58, 68) formed therein and sized so as to fit over the end section means (40) of said truck base upon assembly, wherein said truck cab assembly includes a central cab top means (70) with cab side door panel means (80) formed on either side thereof, cab rear panel means (91) formed on a third side of said cab top means (70), and front cab panel means (95, 96) formed on a fourth side of said cab top means (70), and wherein said cab side door panel means (80) have flap means (81) formed thereon having cut-through portion means for sliding over said tab element means (11, 12) formed in said truck base central main section means (10).

2. The apparatus of claim 1 wherein said front cab panel means (95, 96) comprises a first generally rectangular panel (95) attached to said central cab top means (70) and a second generally rectangular panel (96) attached to said first rectangular panel (95).

3. The apparatus of claim 2 wherein said first rectangular panel (95) of said front cab panel means (95, 96) has flaps (95*a*, 95*b*) formed on both sides thereof.

4. The apparatus of claim 3 wherein said second rectangular panel (96) of said front cab panel means (95, 96) has tabs (96*a*, 96*b*) formed on both sides thereof.

5. The apparatus of claim 4 wherein said cab side door panel means (80) have flap means (82) formed on front portions thereof, said flap means (82) having cut through section means formed therein to cooperatively receive the tabs (96*a*, 96*b*) formed on said cab front panel means (96) upon assembly of the device.

6. The apparatus of claim 5 wherein said cab rear panel means (91) has a slotted flap means (92, 93) formed thereon for cooperation with said end section tab means (42) upon assembly of the device.

* * * * *